US010426680B2

(12) United States Patent
Williams et al.

(10) Patent No.: US 10,426,680 B2
(45) Date of Patent: Oct. 1, 2019

(54) AIR BLADDER CONTROL OF MATTRESS/FRAME WIDTH EXPANSION

(71) Applicant: Hill-Rom Services, Inc., Batesville, IN (US)

(72) Inventors: Joshua A Williams, West Harrison, IN (US); Luke Gibson, Greensburg, IN (US); Fengshuan Zhou, Cary, NC (US)

(73) Assignee: Hill-Rom Services, Inc., Batesville, IN (US)

( * ) Notice: Subject to any disclaimer, the term of this patent is extended or adjusted under 35 U.S.C. 154(b) by 500 days.

(21) Appl. No.: 15/214,530

(22) Filed: Jul. 20, 2016

(65) Prior Publication Data

US 2017/0027786 A1 Feb. 2, 2017

Related U.S. Application Data

(60) Provisional application No. 62/199,610, filed on Jul. 31, 2015.

(51) Int. Cl.

| | |
|---|---|
| ***A47C 27/10*** | (2006.01) |
| ***A61G 7/018*** | (2006.01) |
| ***A61G 7/05*** | (2006.01) |
| ***A61G 7/057*** | (2006.01) |

(52) U.S. Cl.

CPC ..... *A61G 7/018* (2013.01); *A61G 7/0507* (2013.01); *A61G 7/0525* (2013.01); *A61G 7/05776* (2013.01)

(58) Field of Classification Search

CPC ..... A61G 7/018; A47C 27/10
USPC ..... 5/706, 710, 713, 181, 185
See application file for complete search history.

(56) References Cited

U.S. PATENT DOCUMENTS

| | | | |
|---|---|---|---|
| 3,220,021 | A | 11/1965 | Nelson |
| 3,220,022 | A | 11/1965 | Nelson |
| 3,413,663 | A | 12/1968 | Swann |
| 3,893,197 | A | 7/1975 | Ricke et al. |
| 4,409,695 | A | 10/1983 | Johnston et al. |
| 4,486,908 | A | 12/1984 | Schroeder |
| 4,669,136 | A | 6/1987 | Waters et al. |
| 4,700,417 | A | 10/1987 | McGovern |
| 4,805,249 | A | 2/1989 | Usman et al. |
| 4,847,929 | A | 7/1989 | Pupovic |
| 4,985,946 | A | 1/1991 | Foster et al. |
| 4,987,623 | A | 1/1991 | Stryker et al. |
| 5,023,967 | A | 6/1991 | Ferrand |

(Continued)

FOREIGN PATENT DOCUMENTS

| | | |
|---|---|---|
| EP | 2 6398 137 A1 | 2/2014 |
| WO | 99/15126 A2 | 4/1999 |

(Continued)

OTHER PUBLICATIONS

European Search Report for EP 16 18 1634 dated Dec. 12, 2016, 7 pages.

*Primary Examiner* — Fredrick C Conley
(74) *Attorney, Agent, or Firm* — Barnes & Thornburg LLP

(57) ABSTRACT

According to the present disclosure, a patient support system includes a patient support device having extension chambers and a deck including extendable side deck portions. Upon caregiver selection, the side deck portions extended and retract by inflation and deflation of the extension chambers to provide an extended patient support surface.

20 Claims, 8 Drawing Sheets

(56) References Cited

U.S. PATENT DOCUMENTS 5,077,843 A 1/1992 Foster et al.
5,083,332 A 1/1992 Foster et al.
5,179,744 A 1/1993 Foster et al.
5,345,629 A 9/1994 Ferrand
5,377,370 A 1/1995 Foster
5,398,357 A 3/1995 Foster
5,479,666 A 1/1996 Foster et al.
5,628,078 A 5/1997 Pennington et al.
5,724,685 A 3/1998 Weismiller et al.
5,745,936 A 5/1998 Van McCutchen et al.
5,802,646 A 9/1998 Stolpmann et al.
5,815,865 A 10/1998 Washburn et al.
5,940,910 A 8/1999 Weismiller et al.
6,021,533 A 2/2000 Ellis et al.
6,295,675 B1 10/2001 Ellis et al.
6,324,709 B1 12/2001 Ikeda et al.
6,357,065 B1 3/2002 Adams
6,374,438 B1 4/2002 Fox et al.
6,378,152 B1 4/2002 Washburn et al.
6,427,264 B1 8/2002 Metz et al.
6,460,209 B1 10/2002 Reeder et al.
6,499,167 B1 12/2002 Ellis et al.
6,615,426 B1 9/2003 Risk, Jr.
6,678,908 B2 1/2004 Borders et al.
6,687,935 B2 2/2004 Reeder et al.
6,694,549 B2 2/2004 Perez et al.
6,704,954 B2 3/2004 Metz et al.
6,760,939 B2 7/2004 Ellis et al.
6,820,293 B2 11/2004 Alverson
6,880,189 B2 4/2005 Welling et al.
6,971,132 B2 12/2005 Feinsod
7,076,818 B2 7/2006 Kummer et al.
7,086,107 B2 8/2006 Ellis et al.
7,200,882 B2 4/2007 Heimbrock
7,210,180 B2 5/2007 Malcolm
7,216,389 B2 5/2007 Ellis et al.
7,225,489 B1 * 6/2007 Frickey ..... A47C 19/04 5/690
7,353,556 B2 4/2008 Ellis et al.
7,353,557 B2 4/2008 Ellis et al.
7,406,729 B2 8/2008 Hornbach et al.
7,426,760 B2 9/2008 Vrzalik
7,430,771 B2 10/2008 Heimbrock
7,565,710 B2 7/2009 Chambers et al.
7,669,263 B2 3/2010 Menkedick et al.
7,676,861 B2 3/2010 Ward et al.
7,676,862 B2 3/2010 Poulos et al.
7,703,158 B2 4/2010 Wilker, Jr. et al.
7,730,562 B2 6/2010 Hornbach et al.
7,743,441 B2 6/2010 Poulos et al.
7,757,318 B2 7/2010 Poulos et al.
7,779,494 B2 8/2010 Poulos et al.
7,788,747 B2 9/2010 Kramer et al.
7,802,332 B2 9/2010 Kummer et al.
7,805,782 B2 10/2010 Hakamiun et al.
7,827,632 B2 11/2010 Vrzalik
7,895,689 B2 3/2011 Hayes et al.
7,917,978 B2 4/2011 Ruschke et al.
7,930,778 B2 4/2011 Wu et al.
7,975,332 B2 7/2011 Hensley et al.
8,056,160 B2 11/2011 Poulos et al.
8,056,165 B2 11/2011 Kummer et al.
8,069,514 B2 12/2011 Poulos et al.
8,104,122 B2 1/2012 Richards et al.
8,122,546 B2 2/2012 Chambers et al.
8,205,280 B2 6/2012 Hensley et al.
8,239,986 B2 8/2012 Heimbrock et al.
8,286,282 B2 10/2012 Kummer et al.
8,296,884 B2 10/2012 Heimbrock
8,341,778 B2 1/2013 Heimbrock
8,397,324 B2 3/2013 Hayes et al.
8,453,283 B2 6/2013 O'Keefe
8,474,076 B2 7/2013 Hornbach
8,510,879 B2 8/2013 Hensley et al.
8,539,625 B2 9/2013 Poulos et al.
8,677,536 B2 3/2014 Douglas
8,732,875 B2 5/2014 O'Keefe
8,789,224 B2 7/2014 Wyatt et al.
8,898,838 B1 12/2014 Tu
8,997,282 B2 4/2015 Bossingham et al.
8,997,283 B2 4/2015 Bourgraf, Jr. et al.
9,009,893 B2 4/2015 Kramer et al.
9,089,459 B2 7/2015 Dindas et al.
9,119,753 B2 9/2015 Poulos et al.
9,173,797 B2 11/2015 Andrienko
9,320,663 B2 4/2016 Poulos et al.
9,381,125 B2 7/2016 Herbst et al.
2001/0044971 A1 11/2001 Borders et al.
2002/0133883 A1 9/2002 Perez et al.
2003/0159219 A1 8/2003 Harrison et al.
2003/0167568 A1 9/2003 Brooke
2004/0034931 A1 2/2004 Kummer et al.
2004/0133987 A1 7/2004 Reeder et al.
2004/0143904 A1 7/2004 Borders et al.
2004/0158923 A1 8/2004 Perez et al.
2004/0255386 A1 12/2004 Liu
2005/0028289 A1 2/2005 Hakamiun
2005/0081295 A1 4/2005 Malcolm
2005/0172405 A1 8/2005 Menkedick et al.
2006/0021142 A1 2/2006 Hornbach
2006/0026762 A1 2/2006 Hornbach et al.
2006/0026767 A1 * 2/2006 Chambers ..... A61G 7/0507 5/713
2006/0026768 A1 2/2006 Chambers et al.
2006/0053555 A1 3/2006 Poulos et al.
2006/0053562 A1 3/2006 Poulos et al.
2006/0059621 A1 3/2006 Poulos et al.
2006/0059624 A1 3/2006 Poulos et al.
2006/0090261 A1 5/2006 Vrzalik
2006/0101580 A1 5/2006 Biggie et al.
2006/0162075 A1 7/2006 Waldman et al.
2006/0168728 A1 * 8/2006 Strobel ..... A61G 7/05 5/618
2006/0195984 A1 9/2006 HakamiuN et al.
2006/0253982 A1 11/2006 Kummer et al.
2007/0000056 A1 1/2007 Ward et al.
2007/0136949 A1 6/2007 Richards et al.
2007/0169271 A1 7/2007 Allen et al.
2007/0180617 A1 8/2007 Kramer et al.
2007/0180626 A1 8/2007 Ellis et al.
2007/0234482 A1 10/2007 Wright
2008/0000028 A1 1/2008 Lemire et al.
2008/0010748 A1 1/2008 Menkedick et al.
2008/0040857 A1 2/2008 Karmer et al.
2008/0201844 A1 8/2008 Gemeline et al.
2008/0282469 A1 11/2008 Hayes et al.
2008/0282472 A1 11/2008 Hornbach et al.
2008/0289107 A1 11/2008 Vrzalik
2008/0295248 A1 12/2008 Hayes et al.
2009/0113633 A1 5/2009 Hayes et al.
2009/0229050 A1 9/2009 Heimbrock
2009/0293197 A1 12/2009 Larson et al.
2010/0005592 A1 1/2010 Poulos et al.
2010/0107335 A1 5/2010 Poulos et al.
2011/0099723 A1 5/2011 Chambers et al.
2011/0113561 A1 5/2011 Douglas
2011/0232001 A1 9/2011 Poulos et al.
2012/0198629 A1 8/2012 Hornbach
2012/0271350 A1 10/2012 Palmer
2013/0227787 A1 9/2013 Herbst et al.
2013/0298331 A1 11/2013 Bossingham et al.
2014/0026325 A1 * 1/2014 Guthrie ..... A47C 27/088 5/709

FOREIGN PATENT DOCUMENTS

WO 2006036523 A1 4/2006
WO 2013058753 A1 4/2013

* cited by examiner

AIR BLADDER CONTROL OF MATTRESS/FRAME WIDTH EXPANSION

PRIORITY CLAIM

This application claims priority under 35 U.S.C. § 119(e) to U.S. Provisional Application No. 62/199,610, filed Jul. 31, 2015, which is expressly incorporated by reference herein.

BACKGROUND

The present disclosure relates to patient support systems. Specifically, the present disclosure relates to patient support systems which include patient support devices that can be adjusted in width to provide extended patient support surfaces.

Patient support devices, such as hospital beds, can accommodate bariatric patients by enabling width-extension of their patient support surfaces. In order to permit movement of the beds throughout conventionally sized facilities, such as through standard hospital doorways and hallways, the beds can be equipped for width-retraction.

SUMMARY

The present application discloses one or more of the features recited in the appended claims and/or the following features which, alone or in any combination, may comprise patentable subject matter:

According to one aspect of the present disclosure, a patient support system for supporting a patient includes a bed including a deck and extension chambers. The deck has a main deck portion and side deck portions connected to the main deck portion at opposing longitudinal sides of the main deck portion. The bed includes a controller configured to send a command signal indicative of a command for supply of fluid to the extension chambers. The bed includes a fluid supply device configured to receive the command signal to supply fluid to the extension chambers. The extension chambers are configured to receive fluid from the fluid supply device to drive the side deck portions between a retracted position and an extended position, and are configured to support the patient.

In some embodiments, the side deck portions are slidingly connected to the main deck portion.

In some embodiments, each side deck portions is connected to the main deck portion by an extension track for translating the side deck portions between the retracted and extended positions.

In some embodiments, each extension track includes a lock configured to selectively engage the side deck portions with the main deck to prevent movement therebetween.

In some embodiments, the bed includes a mattress and the extension chambers are formed as portions of the mattress.

In some embodiments, the mattress defines a patient support surface of the bed and the extension chambers are configured to provide an additional patient support surface upon extension of the side deck portions from the main deck portion, the patient support surface and the additional patient support surface together define an extended patient support surface.

In some embodiments, each of the extensions chambers is connected to a respective one of the side deck portions such that upon inflation of one of the extension chambers the respective side deck portion is driven outwardly from the main deck portion.

In some embodiments, each side deck portion includes an outward end, and each of the extension chambers is positioned between a mattress of the bed and the outward end of the respective side deck portion.

In some embodiments, the bed includes a mattress and the extension chambers each form a portion of the mattress, wherein the bed includes a foam bolster positioned between each extension chamber and a mattress center portion, and another foam bolster positioned on an outward end of each extension chamber.

In some embodiments, the bed includes elastic bands encircling the foam bolsters to sandwich the extension chambers therebetween so as to provide a compressive exhaust force for deflation of the extension chambers.

In some embodiments, each extension chamber is connected to its respective side deck portion by fastening of the extension chamber to the side deck portion.

In some embodiments, the fastening is by snap-connection.

In some embodiments, a bottom side of each extension chamber is connected to a top side of its respective side deck portion.

In some embodiments, each extension chamber is connected to its respective side deck portion by connection with a flange extending perpendicularly from the respective side deck portion.

In some embodiments, the extension chambers comprise a drive mechanism configured to extend and retract the side deck portions.

In some embodiments, the bed comprises no other drive mechanism capable of extension of the side deck portions.

According to another aspect of the disclosure, a patient support system for supporting a patient includes a bed including a deck and extension chambers, the deck having a main deck portion and side deck portions connected to the main deck portion at opposing longitudinal sides of the main deck portion, a controller configured to receive a user input indicating a desired position of the side deck portions between a retracted and an extended position, to determine a pressurization level required for the extension chambers to achieve the desire position, and to send a command signal indicating a requirement for transfer of fluid to or from the extension chambers, a fluid supply device configured to receive the command signal. The extension chambers are configured to receive fluid from the fluid supply device to drive the side deck portions between the retracted position and the extended position, and are configured to support the patient.

According to another aspect of the present disclosure, a method of operating a patient support system includes receiving an input indicating a desired bed width, determining a required state of inflatable extension chambers required to achieve the desired bed width, and operating a fluid supply system to pressurize the extension chambers to achieve the required state.

In some embodiments, determining the required state comprises determining a current bed width. In some embodiments, determining the required state comprises determining a current pressurization level of the extension chambers.

Additional features alone or in combination with any other feature(s), including those limited above, those listed in the claims, and those described in detail below, can comprise patentable subject matter. Other will become apparent to those skilled in the art upon consideration of the detailed description of the illustrative embodiments exemplifying the best mode of carrying out the invention as presently presented.

BRIEF DESCRIPTION OF THE DRAWINGS

The detailed description particularly refers to the accompanying figures in which.

DETAILED DESCRIPTION

Patient support systems for use in care facilities, such as hospitals, may include patient support devices. Patient support devices, such as beds, can accommodate bariatric patients by having a wide width. Patient support devices that can accommodate bariatric patients can be enabled for easy maneuvering through facilities by being operable for width adjustment. Configured in a wide-width mode, a patient support system can comfortably accommodate a bariatric patient. Configured in a narrow-width mode, a patient support system can easily pass through conventionally sized areas, such as standard hospital doorways and hallways. A user, such as a caretaker, can operate the bed to achieve configuration between the narrow-width mode to the wide-width mode.

Figure 1A:
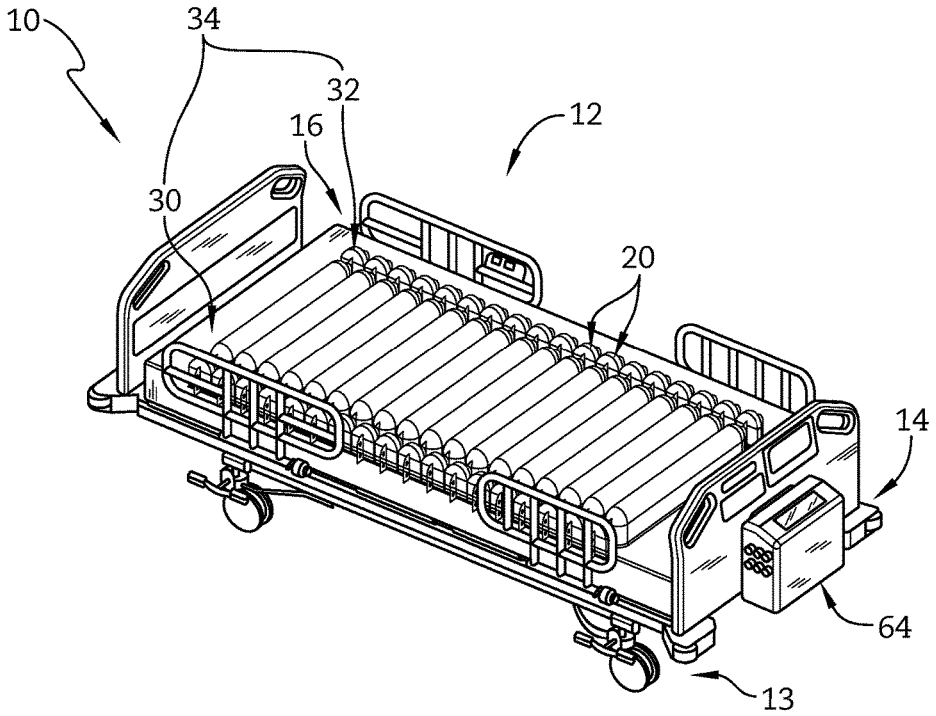
FIG. 1A is a perspective view of a patient support system including a bed having a frame, a deck, and a mattress including extension chambers, the bed being configured such that the extension chambers are in a deflated mode and side deck portions are in a retracted position.
Figure 1B:
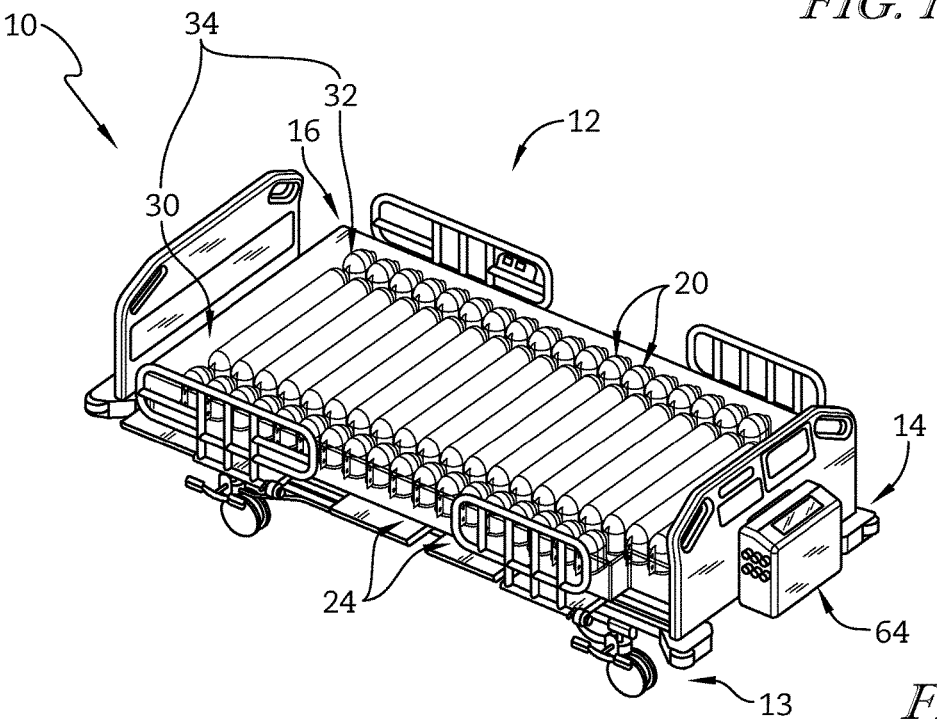
FIG. 1B is a perspective view of a patient support system of FIG. 1A with the bed being configured such that the extension chambers are in an inflated mode and side deck portions are in an extended position.

In illustrative embodiments, a patient support system 10 includes a patient support device, embodied as a hospital bed 12, as shown in FIGS. 1A and 1B. The bed 12 illustratively includes a mattress 16 having a plurality of extension chambers 20 disposed therein on each side. The patient support system 10 can be selectively operated between a narrow-width and a wide-width by directing pressurized fluid to and/or from chambers 20. Adjustable width of the bed 12 enables accommodation of bariatric patients while permitting easy passage of the bed 12 through conventionally sized areas, such as standard hospital doorways and hallways.

Figure 2A:
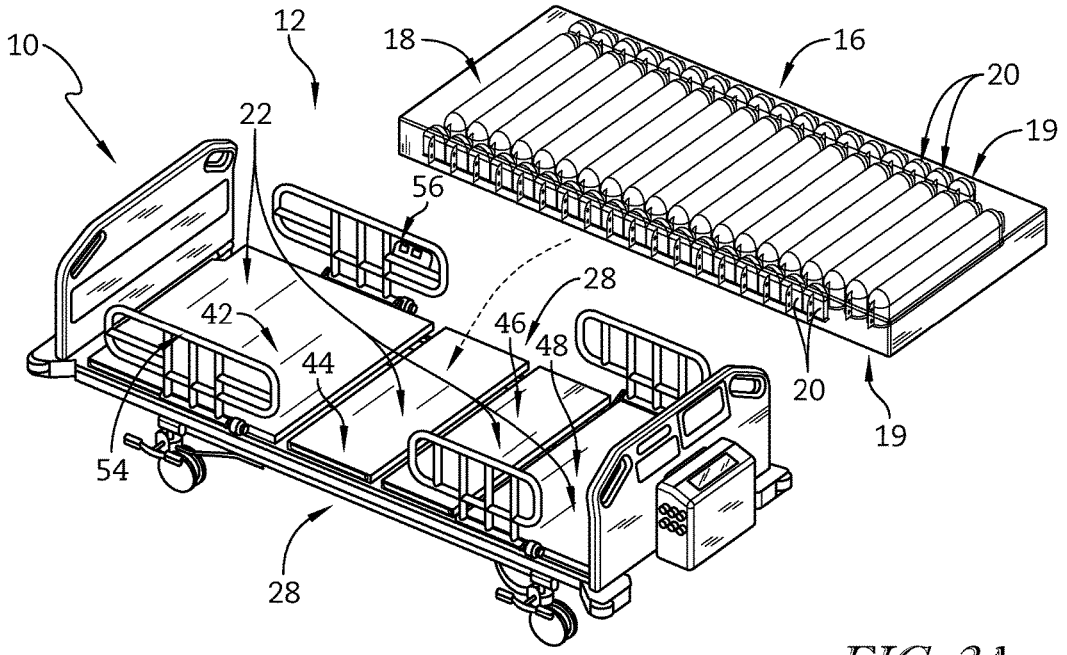
FIG. 2A is a perspective partially exploded view of the patient support system of FIG. 1A.
Figure 2B:
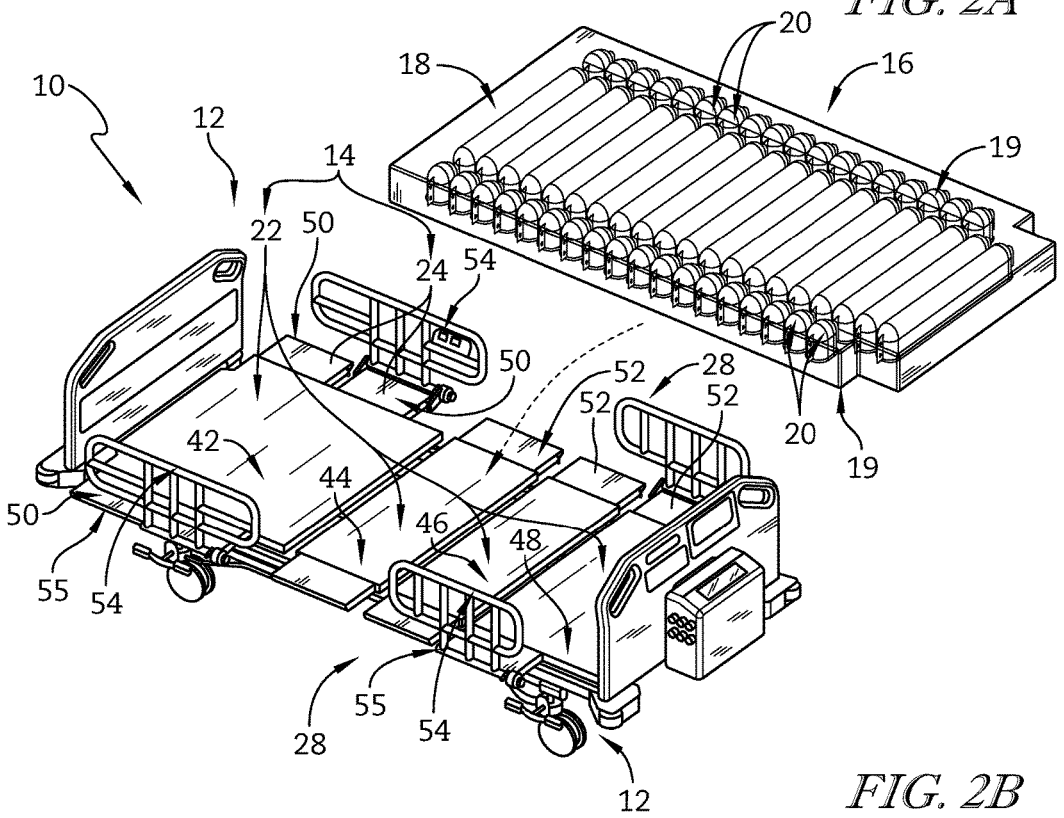
FIG. 2B is a perspective partially exploded view of the patient support system of FIG. 1B.
Figure 4:
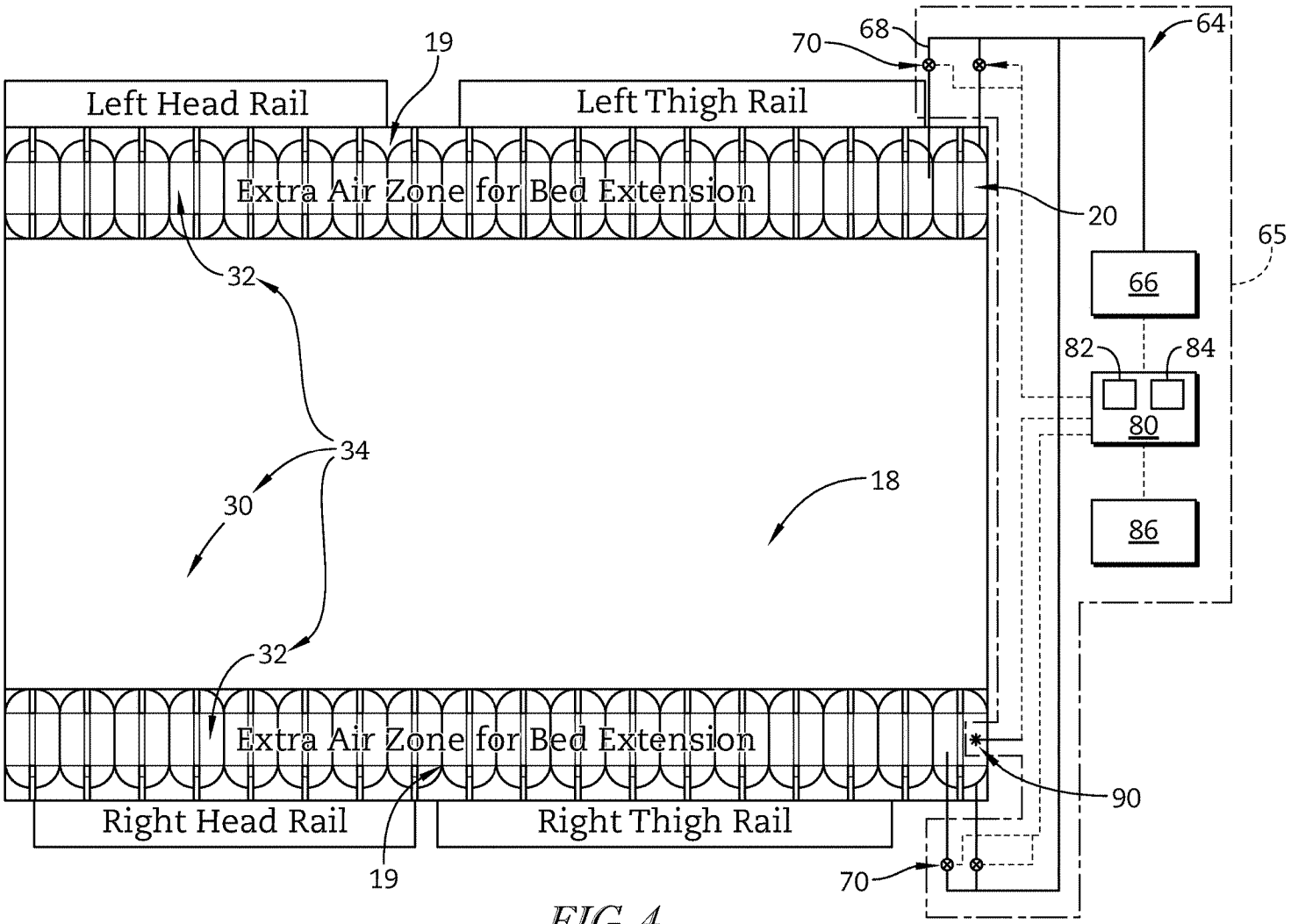
FIG. 4 is a diagrammatic plan view of the patient support system of FIGS. 1-3.

The bed 12 illustratively includes a frame 13, a deck 14, and a mattress 16 as shown in FIGS. 1A and 1B. The frame 13 supports the deck 14 which, in turn, supports the mattress 16 as shown in FIGS. 1A-2B. The deck 14 of bed 12 includes a center deck portion 22 and side deck portions 24 as illustratively suggested in FIGS. 2A and 2B. The mattress 16 includes a center mattress portion 18 and side mattress portions 19 that illustratively include extension chambers 20 as shown in FIGS. 1A-2B. The deck 14 and the mattress 16 can be operated between a retracted-width and an extended-width by directing pressurized fluid to and/or from the chambers 20 of the mattress 16 by a bed extension control system 65 as shown in FIGS. 1, 2, and 4.

As shown in FIGS. 1A and 1B, the mattress 16 is illustratively positioned on top of the deck 14 and defines a patient support surface 30. As illustratively shown in FIG. 4, the extension chambers 20 can be inflated by a bed extension control system 65 to create an additional patient support surface 32. The patient support surface 30 and the additional patient support surface 32 together define an extended patient support surface 34. As shown in FIG. 1A, the extension chambers 20 can be deflated to collapse the additional patient support surface 32.

As illustratively shown in FIGS. 2A and 2B, the center mattress portion 18 is supported by the center deck portion 22 of the deck 14. The side mattress portions 19 are supported by side deck portions 24. Deflation and inflation of the extension chambers 20 drives the side deck portions 24 respectively between a retracted position (suggested in FIGS. 1A and 2A) and an extended position (suggested in FIGS. 2A and 2B) without separate powered extension drive for the side deck portions 24. Upon inflation of the extension chambers 20, the side deck portions 24 are driven outwardly to support the additional patient support surface 32. A caregiver can thus configure the bed 12 between a narrow mode having the patient support surface 30 and a wide mode having the extended patient support surface 34.

Figure 3:
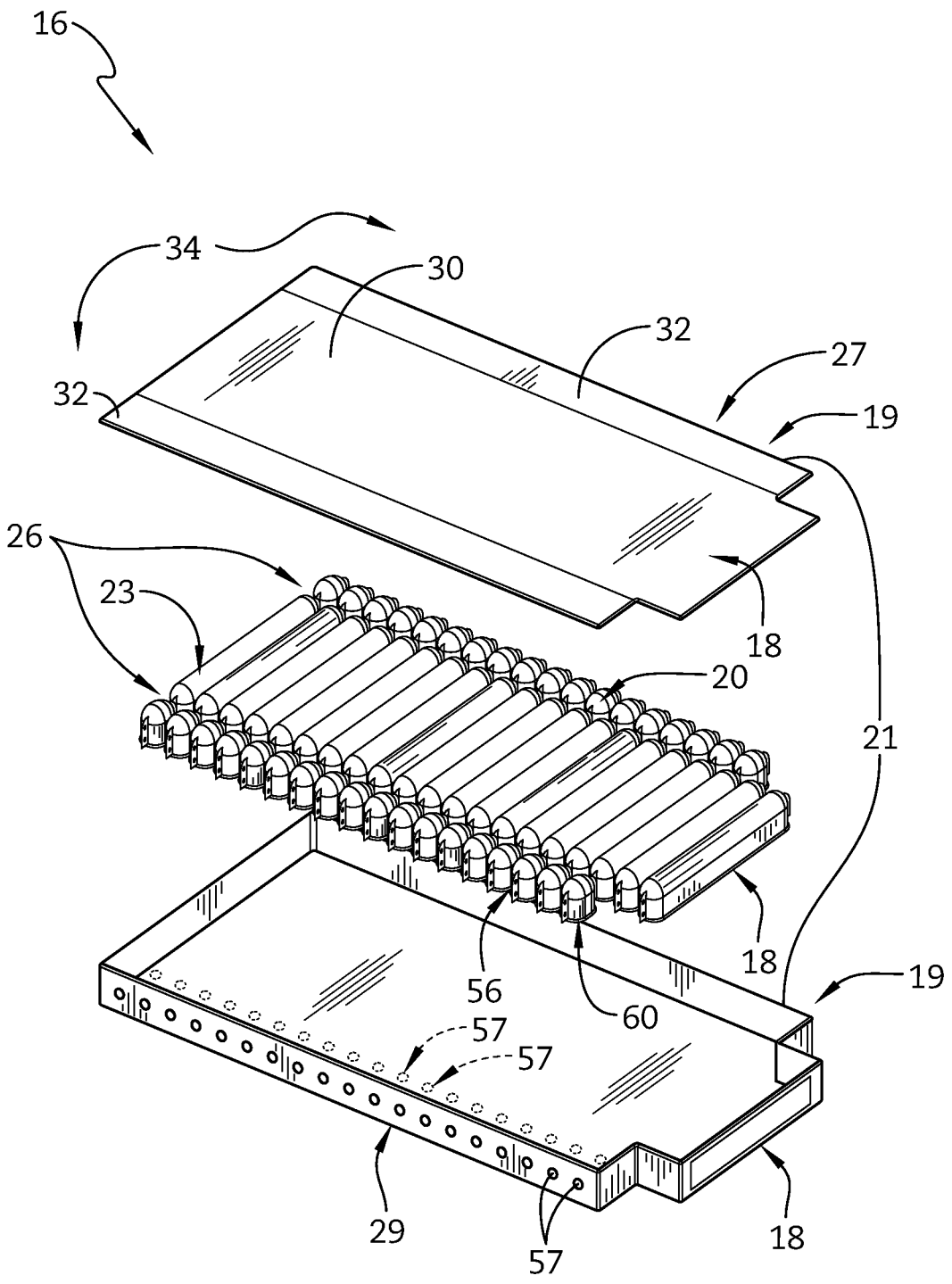
FIG. 3 is an exploded perspective view of a mattress of the patient support device of FIGS. 1-2B.

The mattress 16 includes the extension chambers 20 as shown in FIGS. 1-4. The extension chambers 20 are illustratively attached to the center mattress portion 18 at each lateral side 26 of the center mattress portion 18 as shown in FIG. 3. The length and width of the center mattress portion 18 illustratively correspond to the length and width of the center deck portion 22, respectively. The width of the extension chambers 20 in the extension direction correspond to the width of the side deck portions 24 in the extension direction.

In the illustrative embodiment of the present disclosure, the extension chambers 20 are width extension bladders as shown in FIG. 3. The extension chambers 20 are illustratively arranged within an outer mattress cover 21 that includes upper ticking 27 and lower ticking 29 as shown in FIG. 4. The extension chambers 20 illustratively define individual fluid bladders arranged to extend in the extension direction (lateral direction) and align with respective support bladders 23 within the center mattress portion 18 as shown in FIGS. 1-3. The extension chambers 20 are illustratively equal to each other in size and shape and are positioned successively from the head end to foot end of the mattress 16 along the longitudinal sides 26 of the center mattress portion 18 with contact between adjacent extension chambers 20. In some embodiments, the extension chambers 20 may comprise one or more bladders extending lengthwise from head to foot of the bed 12.

Figure 9A:
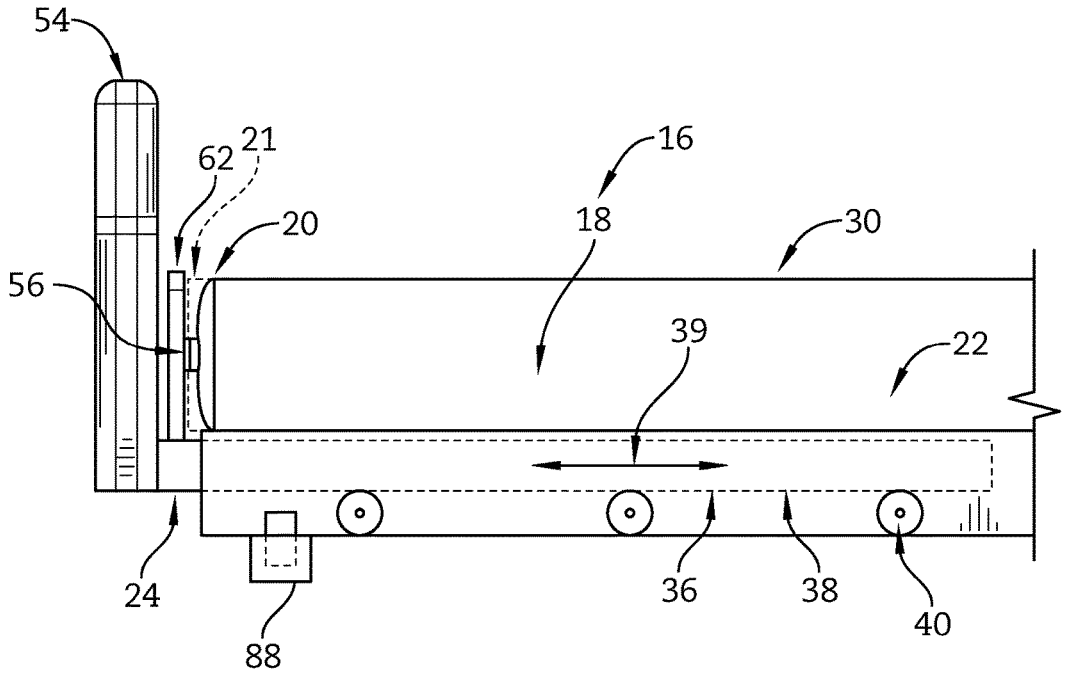
FIG. 9A is a side view of the bed of the patient support system of FIGS. 1-3 according to the present disclosure with the extension chambers deflated.
Figure 9B:
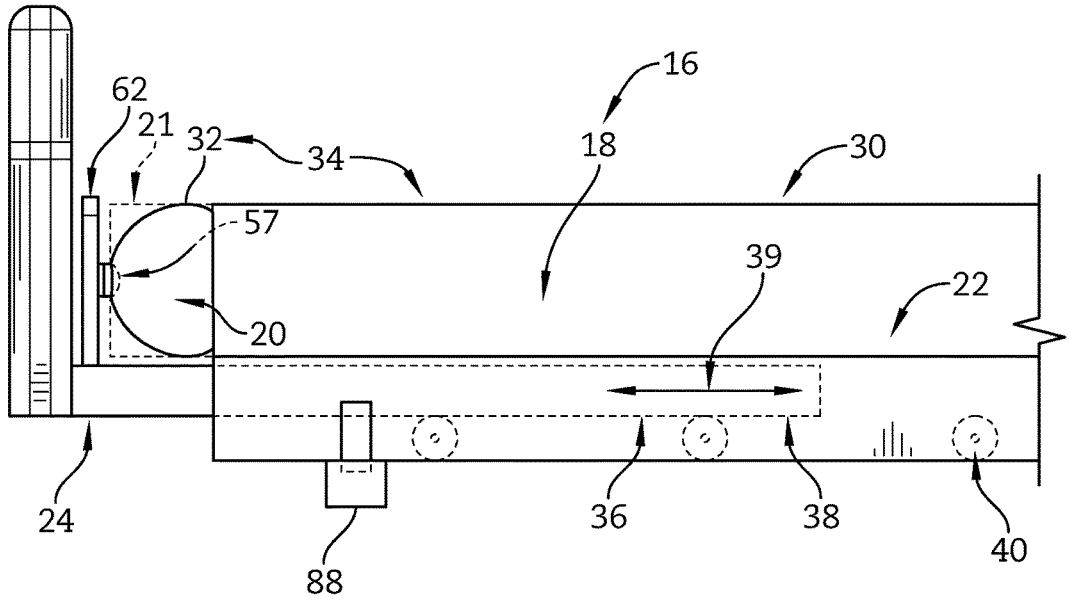
FIG. 9B is a side view of the bed of the patient support system of FIGS. 1-3 according to the present disclosure with the extension chambers inflated.

The side deck portions 24 are connected to the center deck portion 22 at opposing lateral sides 28 of the center deck portion 22 as illustratively shown in FIGS. 2A and 2B. The side deck portions 24 are illustratively slidingly connected to the center deck portion 22 and configured to be movable between a retracted position (shown in FIGS. 2A and 9A) and an extended position (shown in FIGS. 2B and 9B) according to the configuration of the extension chambers. In the illustrative embodiment as shown in FIGS. 9A and 9B, the side deck portions 24 are mounted to the center deck portion 22 by a roller track connection in which the side deck portions 24 include tracks 36 having a lower side 38 supported by contact with a top side of track wheels 40 that are rotatably mounted to the center deck portion 22.

In FIG. 2A, the extension chambers 20 are illustratively shown in the deflated state with the side deck portions 24 illustratively in the retracted position. Upon inflation of the extension chambers 20, the side deck portions 24 are driven outwardly from the center deck portion 22 and slide outwardly toward an extended position illustrated in FIG. 2B. Upon deflation of the extension chambers 20, the side deck portions 24 are driven inwardly towards the center deck portion 22 and slide inwardly toward a retracted position illustrated in FIG. 2A. The tracks 36 of the side deck portions 24 ride along the track wheels 40 for smooth and sliding translation of the side deck portions 24 between the retracted and the extended positions indicated by arrows 39 as illustratively suggested in FIGS. 2A-B and 9A-B. In some embodiments, the side deck portions 24 may be connected to the center deck portion 22 by any suitable manner to provide smooth movement between the retracted and extended positions, such as rolling, sliding, telescoping, articulating, rotating, translating, etc.

In the illustrative embodiment shown in FIGS. 2A and 2B, the center deck portion 22 comprises a head deck section 42, an upper deck section 44, a lower deck section 46, and a foot deck section 48. The side deck portions 24 comprise head side deck portions 50 of the head deck section 42, and side portions 52 from each of the upper, lower, and foot deck sections 44, 46, 48 as shown in FIG. 2B. The head deck section 42 illustratively includes a number of head side deck portions 50 attached at each longitudinal side 28 of the center deck portion 22 on the head end of the bed 12. One of the number of head side deck portions 50 on each lateral side 28 of the deck 14 illustratively includes a rail 54 attached at an outward end 55 of the head side deck portion 50 and extending vertically from the head side deck portion 50. Each of the upper deck section 44, lower deck section 46 and foot deck section 48 illustratively include corresponding side deck portions 52. In the illustrative embodiment of FIG. 2B, the foot side deck portions 52 each have a rail 54 attached at an outward end 55 of the foot side deck portions 52 and extending vertically from the foot side deck portion 52.

Figure 7:
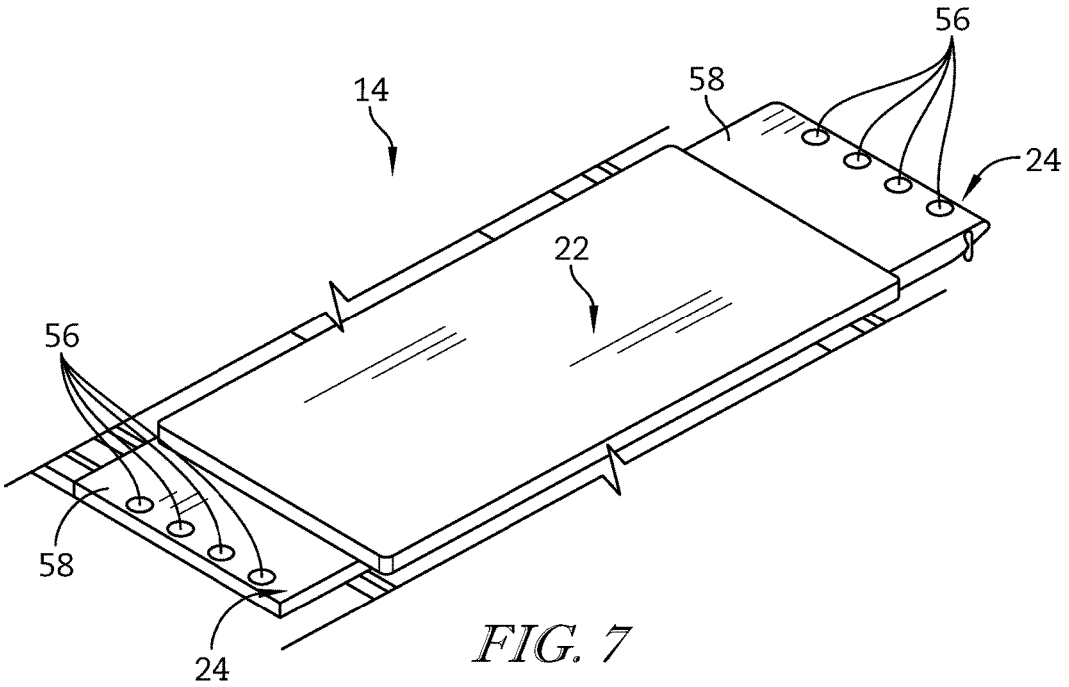
FIG. 7 is a top perspective view of the deck of the patient support system of FIGS. 1-3 having a first embodiment for attachment of the extension chambers according to the present disclosure.

Referring now to the illustrative embodiment shown in FIG. 7, each extension chamber 20 is illustratively attached to one of the side deck portions 24 by a mechanical fastener 56. In the illustrative embodiment, a portion of the mechanical fastener 56 is mounted on a top side 58 of the one of the side deck portions 24 and arranged for connection to another portion of the mechanical fastener 56 that is fixed to a bottom side 60 of one of the extension chambers 20 (suggested in FIG. 3). As illustratively suggested in FIG. 3, the lower ticking 29 may include holes 57 (phantom) on a bottom side thereof through which the portions of each mechanical fastener 56 can penetrate to connect with each other. The mechanical fasteners 56 are illustratively embodied as snap fasteners configured to transfer the lateral forces of inflation and deflation of the extension chambers 20 to the respective side deck portions 24 to achieve sliding extension and retraction of the side deck portions 24. In other embodiments, the fasteners 56 may be any fastener suitable to transfer the lateral forces of inflation and deflation of the extension chambers 20 to the respective side deck portions 24 to achieve sliding extension and retraction of the side deck portions 24. When extended, the side deck portions 24 support the extension chamber 20 to provide the additional patient support surface 32.

Figure 8:
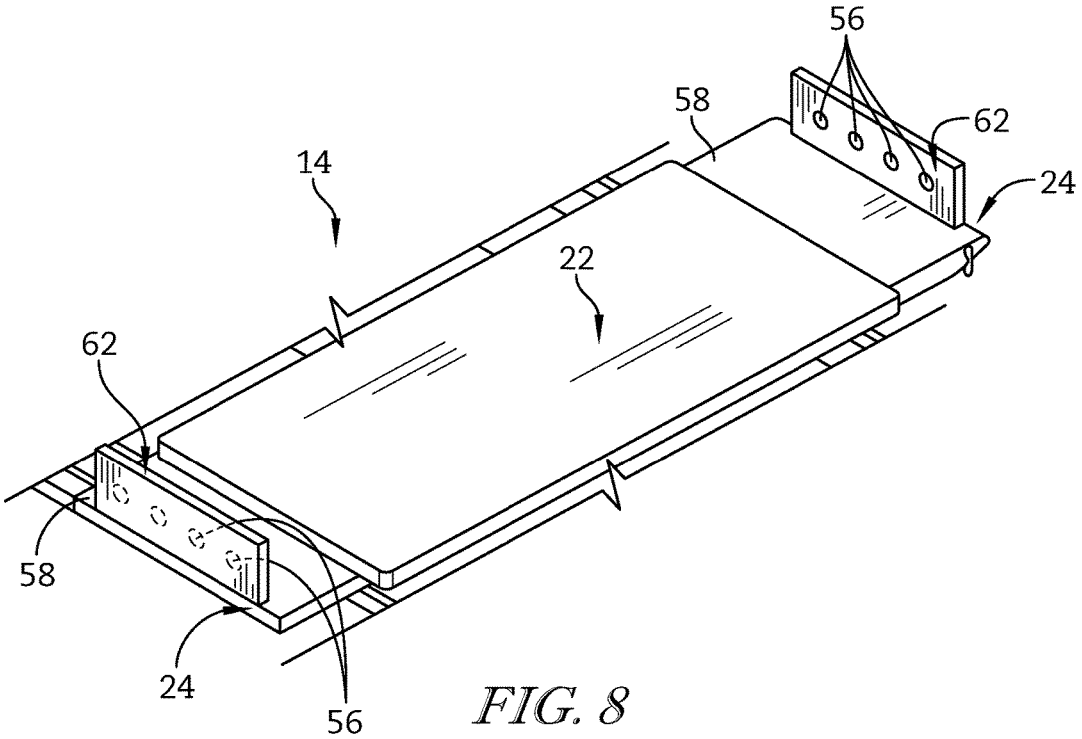
FIG. 8 is a top perspective view of the deck of the patient support system of FIGS. 1-3 having a second embodiment for attachment of the extension chambers according to the present disclosure.

In some embodiments, a portion of the mechanical fastener 56 may be mounted to an inner side of a flange 62 extending perpendicularly from a top side 58 of each side deck portion 24, as shown in FIG. 8, and another portion of the mechanical fastener 56 may be mounted on an outer side of each extension chamber 20 for connection with the portion of the mechanical fastener 56 mounted on the flange 62 as shown in FIGS. 9A-B. In illustrative embodiments, the portion of the fastener 56 on the extension chamber 20 illustratively penetrates holes 57 in the mattress cover 31 (FIG. 3) for connection with the portion of the fastener 56 on the flange 62. In the illustrative embodiment, the mechanical fastener 56 is a single mechanical snap. In some embodiments, the mechanical fastener 56 may be any number of mechanical fasteners for providing attachment of the extension chambers 20 and the side deck portions 24 to allow the extension chambers 20 to drive the side deck portions 24 between a retracted position and an extended position.

Figure 5:
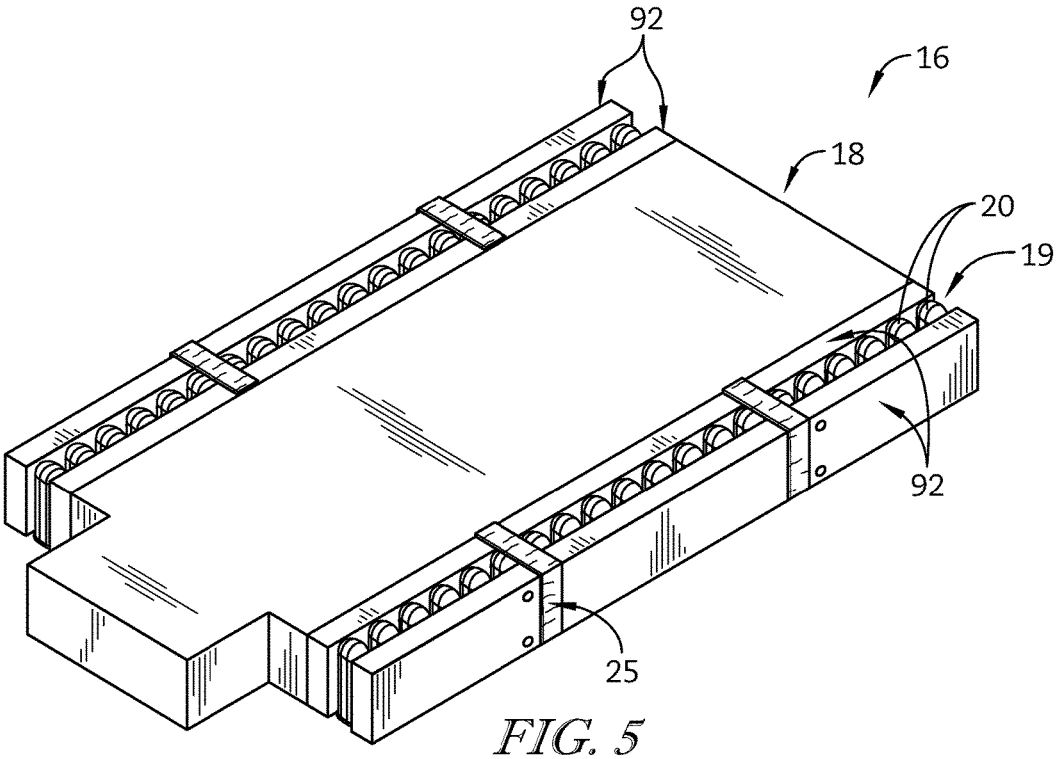
FIG. 5 is a perspective view of another embodiment of a mattress of the similar to that of the patient support system of FIGS. 1-3 configured such that the extension chambers are in an inflated mode.
Figure 6:
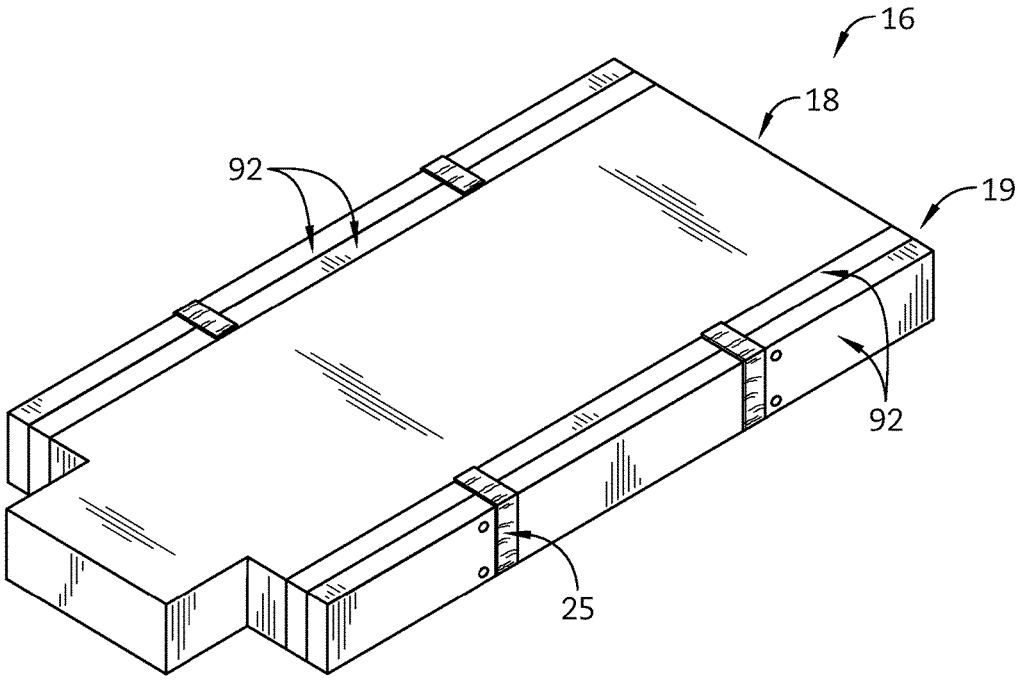
FIG. 6 is a perspective view of the mattress of the patient support system of FIGS. 1-3 according to the present disclosure and configured such that the extension chambers are in a deflated mode.

In the illustrative embodiment as shown in FIGS. 5 and 6, the mattress 16 includes foam bolsters 92 positioned on lateral sides of the extension chambers 20 and cooperating with the cover 31 to define a portion of the patient support surface 30. One of the foam bolsters 92 is illustratively positioned between the center mattress portion 18 and the extension chambers 20. Another of the foam bolsters 92 is illustratively positioned at the outward end in the extension direction of the extension chambers 20 of each side of the mattress 16 as shown in FIG. 5. When an extension chamber 20 is inflated, the foam bolsters 92 on opposite sides of the extension chamber 20 are in a widely spaced-apart relation as shown in FIG. 5. When an extension chamber 20 is not inflated, the foam bolsters 92 on opposite sides of the extension chamber 20 are in a narrowly spaced-apart relation, which can include a contacting relation, as shown in FIG. 6. The foam bolsters 92 are configured provide support at the functional edges of the patient support surfaces 30, 34.

Returning now to the illustrative embodiment suggested in FIG. 4, bed extension control system 65 includes the fluid supply system 64, the bed extension controller 80, and a user interface 86. The fluid supply system 64 supplies pressurized fluid to and from the extension chambers 20 for inflation and deflation thereof according to the bed extension controller 80. As discussed below, in the illustrative embodiment, a fluid supply device 66 provides pressurized fluid to and from the extension chambers 20. Ingress of pressurized fluid to the extension chambers 20 increases the pressure within the extension chambers 20 to inflate the extension chambers 20 to an inflated state suggested in FIGS. 1B and 2B. Egress of pressurized fluid from the extension chambers 20 decreases the pressure within the extension chambers 20 to deflate the extension chambers 20 to a deflated state suggested in FIGS. 1A and 2A.

The fluid supply system 64 includes the fluid supply device 66, fluid communication lines 68, and fluid control valves 70 as illustratively suggested in FIG. 4. The fluid supply device 66 provides pressurized fluid, typically air, to and from the extension chambers 20 to inflate and deflate the extension chambers 20 for extension and retraction of the side deck portions 24 and selective creation of the additional patient support surface 32 as mentioned above. In the illustrative embodiment, the fluid supply device 66 is a reversible pump configured to provide pressurized air to the extension chambers 20 in a pressurize mode and to suction air from the extension chambers 20 in a suction mode. The fluid communication lines 68 communicate fluid, through the fluid control valves 70, between the fluid supply device 66 and the extension chambers 20.

In the illustrative embodiment of the present disclosure, fluid is communicated to each extension chamber 20 through a dedicated fluid communication line 68 and dedicated fluid control valve 70. The fluid supply system 64 and the extension chambers 20 are configured for individualized control of fluid ingress and egress, including with commensurate individualized commands signals mentioned below. In some embodiments, fluid supply system 64 and the extension chambers 20 may be configured for control as part of a group of extension chambers 20, for example, a group of extension chambers 20 which are attached to a common side deck portion 24, a common one of the head side deck portions 50, a common one of the upper, lower, and/or foot side deck portions 52, and/or any combination thereof. Such group control may include any combination of shared and/or dedicated fluid supply system components with common command signals.

The fluid supply device 66 and fluid control valves 70 are configured to receive command signals from a bed extension controller 80 that configures the fluid supply device 66 and fluid control valves 70 accordingly to permit fluid communication to inflate and/or deflate the extension chambers 20 to achieve extension and retraction of the side deck portions 24 according to user inputs. Upon a user input indicating adjustment of the patient support system 10 from a configuration between the narrow-width and the wide-width mode into another configuration between the narrow-width and the wide-width mode, the bed extension controller 80 receives the user input, determines the requirements to achieve the new configuration, and performs the desired adjustment.

The bed extension controller 80 illustratively includes a processor 82 and a memory device 84 as shown in FIG. 2. The processor 82 is configured to receive one or more signals indicative of a user input indicating the desired position of the side deck portions 24 between a retracted and an extended position, and one or more signals indicative of a current position of the side deck portions 24.

Figure 10:
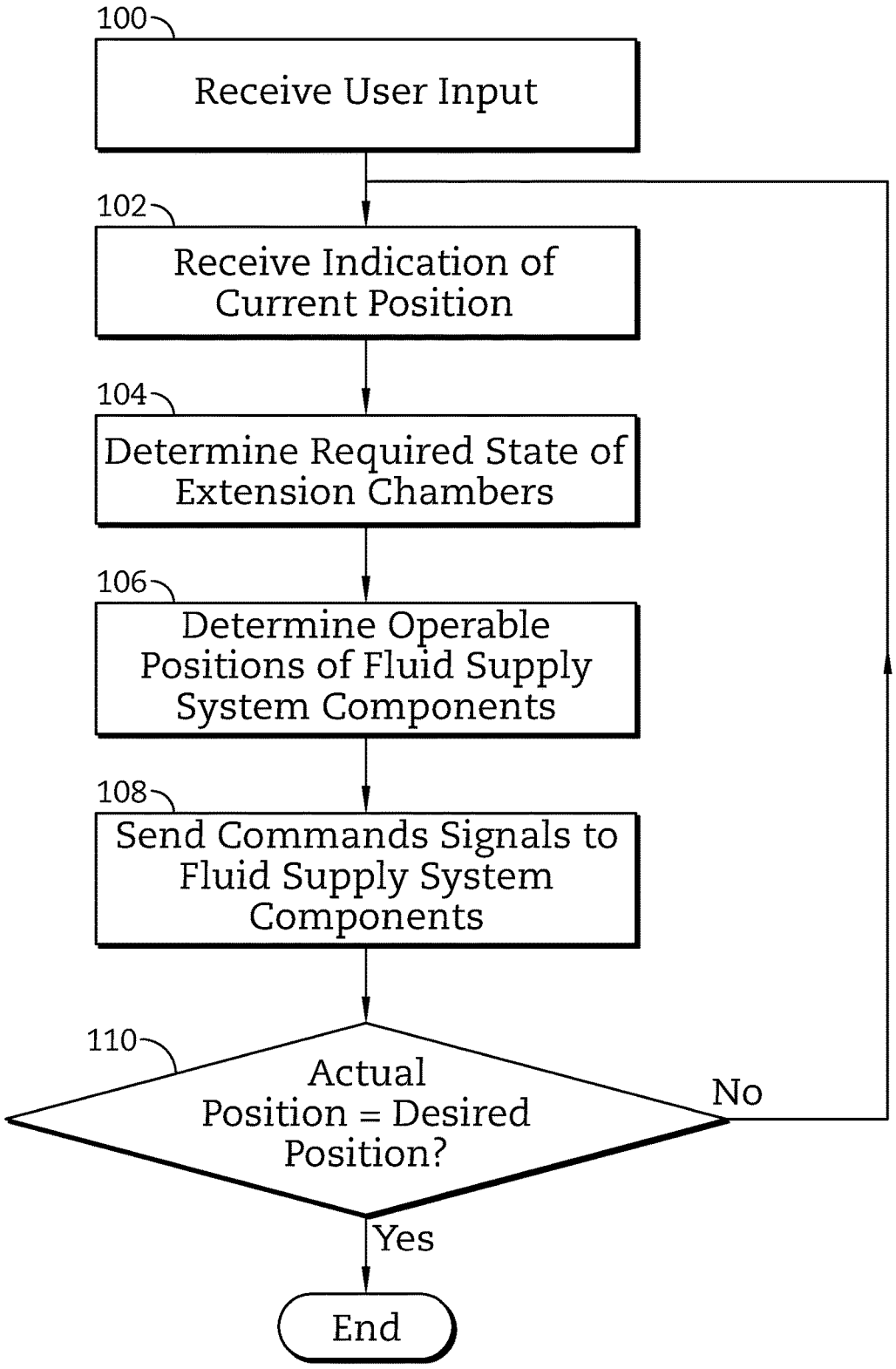
FIG. 10 is a diagrammatic flow chart of a sequence of the patient support system of FIGS. 1-3 according to the present disclosure.

As illustratively suggested by the flow diagram of FIG. 10, in steps 100-110 the bed extension controller 80 receives a signal indicating a desired bed width as user input, and receives signals indicating the current position of the side deck portions 24. The processor 82 determines the requirements of the extension chambers 20 and the fluid supply system 64 required to achieve the desired bed width, and sends a number of command signals to the fluid supply system 64 to achieve the position of the side deck portions 24 according to desired bed width indicated by the user input.

As suggested by the flow diagram of FIG. 10, in steps 100 and 102, the bed extension controller 80 receives signals indicating the user input and the current position of the side deck portions 24. In step 104, the bed extension controller 80 determines the required state of the extension chambers 20 to achieve the desired bed width according to the user input and the current position of the side deck portions 24. In step 106, the controller 80 determines the operable positions of the components of the fluid supply system 64 required to achieve the required state of the extension chambers 20 determined in step 104. In step 108, the bed extension controller 80 sends command signals indicative of the operable positions of the components of the fluid supply system 64, as determined in step 106, to the fluid supply system components. In step 110, the bed extension controller 80 determines whether the actual position matches the desired bed width. Step 110 is illustratively embodied as sensing the pressure within the chambers 20 via sensors 90 to determine if the actual position of the side deck portions 24 corresponds to the desired bed width indicated by the user input. In some embodiments, determining whether the desired bed width has been achieved can be carried out by direct and/or indirect measurement, inference, estimate, and/or any combination thereof.

In illustrative embodiments, the bed extension controller 80 determines the requirements of the extension chambers 20, the current position of the side deck portions 24, and the operable positions of the fluid supply system components by execution of instructions. The memory device 84 store the instructions that, when executed by the processor 82, determine the requirements of the extension chambers 20, the current position of the side deck portions 24, and the operable conditions of the fluid supply device 66 and fluid control valves 70 required to achieve communication of fluid between the fluid supply device 66 and the extension chambers 20 to achieve extension and retraction of the side deck portions 24, while providing adequate pressure to create additional patient support surface 32, based on the current position of the side deck portions 24 and the user input. The instructions include at least one algorithm configured to perform controller functions. In some embodiments, the instructions may include an automated subroutine to maintain and/or adjust the pressure within the extension chambers 20.

As shown in steps 104-108 of FIG. 10, if the bed extension controller 80 determines, based on the user input and the current position of the side deck portions 24, that the side deck portions 24 require extension, the bed extension controller 80 may send commands signals to the fluid supply device 66 to operate in the pressurize mode and to the fluid control valves 70 to permit communication of fluid to provide pressurized fluid to the extension chambers 20. If the bed extension controller 80 determines based on the user input and the current position that the side deck portions 24 require retraction, the bed extension controller 80 may send commands signals to the fluid supply device 66 to operate in the suction mode and to the fluid control valves 70 to permit communication of fluid to remove fluid to the extension chambers 20. Operating of the fluid supply device 66 in one of the pressurize or suction mode while in communication with the chambers 20 drives the side deck portions 24 in one of the retraction or extension directions respectively.

In the illustrative embodiment, signals indicative of a current position of the side deck portions 24 include signals indicative of pressure levels of the extension chambers 20 as determined by pressure sensors 90 of the bed extension control system 65 as illustratively suggested in FIG. 4. Signals indicative of a user input illustratively include inputs from the user interface 86. In some embodiments, signals indicative of a current position of the side deck portions 24 may include signals from any type of mechanical and/or electrical sensor suitable to indicate the position of the side deck portions 24 relative to the center deck portion 22. In some embodiments, signals from either or both of the user interface 86 and pressure sensors 90 may be received by intermediary circuitry, which may include processors and/or other circuitry components, for determining signals for communication to the bed extension controller 80.

In the illustrative embodiment, the bed 12 includes a bias member 25, embodied as elastic bands, configured to provide compressive force to the extension chambers 20 to assist the fluid supply device 66 in suction mode to perform deflation of the extension chambers 20 as shown in FIGS. 5-6 and retraction of the side deck portions 24. In some embodiments, the bias member 25 may comprise any device configured to provide compressive force to evacuate and deflate the extension chambers 20. In some embodiments, the bias member 25 may be configured to provide required force to compress extension chambers 20 into the deflated state and to retract the side deck portions 24, and the bed extension controller 80 may be configured to send command signals to a deflation valve 94 of the fluid supply system 64 to evacuate fluid within the extension chambers 20 to atmosphere based on a user input and the current position. In some embodiments, bias member 25 may be excluded and the fluid supply device 66 may provide fluid evacuation to deflate the extension chambers 20.

The bed 12 includes locks 88 configured to maintain a position of the side deck portions 24 relative to the center deck portion 22 as shown in FIGS. 9A and 9B. In some embodiments, the locks 88 comprise an electro-mechanical latch, for example a solenoid cylinder mounted to the bed and selectively engaging the side deck portion 24. The solenoid may be biased to extend through a portion of the side deck portion 24 to maintain the side deck portions 24 in a fixed position and configured to receive a control signal from the bed extension controller 80 to retract the cylinder from the side deck portion 24 to permit sliding movement of the side deck portions 24. In some embodiments, locks 88 may comprise any type and/or arrangement of locking devices including but not limited to mechanical locks and/or controller based and/or software based locks, including combinations thereof, suitably arranged to fix the position of the side deck portions 24 when translation is not being undertaken by the side deck portions 24 as determined by the bed extension controller 80.

In illustrative embodiments, the extension chambers 20 provide the drive force to extend and retract the side deck portions 24 while providing the additional patient support surface 32. In some embodiments, the extension chambers 20 provide the only powered extension drive force such that no other powered extension drive mechanism is used to extend the side deck portions 24. In some embodiments, the extension chambers 20 are inflated sufficiently to overcome the force of bias members, such as bias members 25, with the side deck portions 24 being locked in place with the locks 88, such that the pressure in the extension chambers 20 can be reduced to a pressure suitable for supporting a patient, the support pressure being lower than the pressure necessary to extend the side deck portions 24. When the side deck portions 24 are to be retracted, the locks 88 are released and the bias members 25 assist with the retraction. It should be understood that the bias members 25 may be employed in any of the embodiments disclosed herein.

In some embodiments, the bed 12 may include various bed controllers for controller of various other bed operations being in addition to and in communication with bed extension controller 80. In some embodiments, bed extension controller 80 may include one or more of shared hardware and/or of shared software components with those of other bed controllers. In some embodiments, bed extension controller 80 may include one or more interface connections configured for communication with other devices and may be configured to receive updates, debugging, and/or other modifications and/or additions to its memory.

Sensors, controllers, and other devices that explicitly and/or implicitly communicate, indicate, receive, and/or transmit any information, communications, indications, transmissions, and/or signals may include one or more receivers, transmitters, and/or combined receiver/transmitters as required to perform their functions.

Communications, signals, transmissions, and indications may be carried out, partly or wholly, through one or more of wireless and wired connections and may include one or more intermediary devices between the source and the destination.

Although certain illustrative embodiments have been described in detail above, variations and modifications exist within the scope and spirit of this disclosure as described and as defined in the following claims.

The invention claimed is:

1. A patient support system for supporting a patient, comprising:

a deck and extension chambers, the deck having a main deck portion and side deck portions connected to the main deck portion at opposing longitudinal sides of the main deck portion, a controller including a processor and a memory device, the memory device including instructions that, when executed by the processor, send a command signal indicating a requirement for transfer of fluid to or from the extension chambers, and a fluid supply device configured to receive the command signal and move fluid into or out of the extension chambers based on the command signal, wherein the extension chambers expand or contract based on the flow to or from the fluid supply device to drive the side deck portions between a retracted position and an extended position, and wherein the extension chambers support the patient.

2. The patient support system of claim 1, wherein the side deck portions are slidingly connected to the main deck portion.

3. The patient support system of claim 1, wherein each side deck portions is connected to the main deck portion by an extension track for translating the side deck portions between the retracted and extended positions.

4. The patient support system of claim 3, wherein each extension track includes a lock configured to selectively engage the side deck portions with the main deck to prevent movement therebetween.

5. The patient support system of claim 1, wherein the patient support apparatus includes a mattress and the extension chambers are formed as portions of the mattress.

6. The patient support system of claim 5, wherein the mattress defines a patient support surface and the extension chambers are configured to provide an additional patient support surface upon extension of the side deck portions from the main deck portion, the patient support surface and the additional patient support surface together defining an extended patient support surface.

7. The patient support system of claim 1, wherein each of the extension chambers is connected to a respective one of the side deck portions such that upon inflation of one of the extension chambers the respective side deck portion is driven outwardly from the main deck portion.

8. The patient support system of claim 7, wherein each side deck portion includes an outward end, and each of the extension chambers is positioned between a mattress and the outward end of the respective side deck portion.

9. The patient support system of claim 8, wherein the extension chambers each form a portion of the mattress, wherein the mattress includes a foam bolster positioned between each extension chamber and a mattress center portion, and another foam bolster positioned on an outward end of each extension chamber.

10. The patient support system of claim 9, wherein the patient support apparatus further includes elastic bands acting on the extension chambers to provide a compressive exhaust force for deflation of the extension chambers.

11. The patient support system of claim 7, wherein each extension chamber is connected to its respective side deck portion by fastening of the extension chamber to the side deck portion.

12. The patient support system of claim 11, wherein the fastening is by snap-connection.

13. The patient support system of claim 11, wherein a bottom side of each extension chamber is connected to a top side of its respective side deck portion.

14. The patient support system of claim 11, wherein each extension chamber is connected to its respective side deck portion by connection with a flange extending perpendicularly from the respective side deck portion.

15. The patient support system of claim 11, wherein the patient support apparatus further includes elastic bands acting on the extension chambers to provide a compressive exhaust force for deflation of the extension chambers.

16. The patient support system of claim 1, wherein the patient support apparatus comprises no other drive mechanism capable of extension of the side deck portions.

17. The patient support system of claim 1, wherein the patient support apparatus further includes elastic bands acting on the extension chambers to provide a compressive exhaust force for deflation of the extension chambers.

18. A patient support system for supporting a patient, comprising:

a bed including a deck and extension chambers, the deck having a main deck portion and side deck portions connected to the main deck portion at opposing longitudinal sides of the main deck portion, a processor configured to send a command signal indicating a requirement for transfer of fluid to or from the extension chambers, and a fluid supply device configured to receive the command signal, wherein the extension chambers are configured to receive fluid from the fluid supply device to drive the side deck portions between a retracted position and an extended position, and are configured to support the patient, wherein each of the extension chambers is connected to a respective one of the side deck portions such that upon inflation of one of the extension chambers the respective side deck portion is driven outwardly from the main deck portion, wherein each side deck portion includes an outward end, and each of the extension chambers is positioned between a mattress and the outward end of the respective side deck portion, wherein the extension chambers each form a portion of the mattress, wherein the mattress includes a foam bolster positioned between each extension chamber and a mattress center portion, and another foam bolster positioned on an outward end of each extension chamber, wherein the patient support apparatus further includes elastic bands encircling the foam bolsters to hold the extension chambers therebetween so as to provide a compressive exhaust force for deflation of the extension chambers.

19. A patient support system for supporting a patient, comprising:

a deck and extension chambers, the deck having a main deck portion and side deck portions connected to the main deck portion at opposing longitudinal sides of the main deck portion, a controller that receives a user input indicating a desired position of the side deck portions between a retracted and an extended position, determines a pressurization level required for the extension chambers to achieve the desire position, and sends a command signal indicating a requirement for transfer of fluid to or from the extension chambers, and a fluid supply device configured to receive the command signal, wherein the fluid supply device moves fluid into and out of the extension chambers based on the command signal to drive the side deck portions between the retracted position and the extended position, and are configured to support the patient.

20. The patient support system of claim 19, wherein the patient support apparatus further includes elastic bands acting on the extension chambers to provide a compressive exhaust force for deflation of the extension chambers.

* * * * *